US005107883A

United States Patent [19]

Shaw

[11] Patent Number: 5,107,883

[45] Date of Patent: Apr. 28, 1992

[54] PINCH VALVE CONTROL SYSTEM FOR WATER LINE ISOLATION AND METHOD

[75] Inventor: Daniel C. Shaw, Geneva, Fla.

[73] Assignee: Bauer Industries, Inc., Orlando, Fla.

[21] Appl. No.: 487,390

[22] Filed: Mar. 2, 1990

[51] Int. Cl.[5] ..... E03B 7/07

[52] U.S. Cl. ..... 137/357; 137/597; 137/883; 251/5

[58] Field of Search ..... 137/883, 885, 597, 357; 251/5, 8, 61.1

[56] References Cited

U.S. PATENT DOCUMENTS

| | | | |
|---|---|---|---|
| 2,212,733 | 8/1940 | Grigsby | 251/8 |
| 2,575,240 | 9/1948 | Thompson . | |
| 3,111,942 | 11/1963 | Miller | 137/563 X |
| 3,447,576 | 11/1965 | Grönlund . | |
| 3,448,759 | 7/1966 | Pierman . | |
| 3,588,034 | 6/1971 | Powell | 251/8 |
| 3,589,602 | 5/1970 | Cushman . | |
| 3,599,525 | 8/1971 | Klann | 251/5 X |
| 3,677,164 | 7/1972 | Traver . | |
| 4,108,418 | 8/1978 | Ensign et al. | 251/5 |
| 4,111,391 | 9/1978 | Pilolla . | |
| 4,683,907 | 8/1987 | Brugnoli . | |

FOREIGN PATENT DOCUMENTS

| | | | |
|---|---|---|---|
| 2155984 | 10/1985 | United Kingdom | 137/883 |

*Primary Examiner*—Stephen M. Hepperle
*Attorney, Agent, or Firm*—Shlesinger & Myers

[57] ABSTRACT

A pinch valve control system for regulating the flow of water through the water distribution network of a building. Remote-controlled, fluid-operated pinch valves are spaced at various locations throughout the water distribution network of the building and may be selectively operated from a remote station to stop the flow of water in any pipe throughout the building's water distribution network. The use of pinch valves permits water flow to be increased or decreased gradually and reduces or eliminates water hammer. The pinch valve is operated by compressed fluid which enters the sleeve around the pinch valve to stop the flow of water in the pipe. To resume the water flow, the fluid in the pinch valve is released.

24 Claims, 5 Drawing Sheets

B
20
14
28
26
24
22
21
30
60
12
16
72
70
10
18
45

PINCH VALVE CONTROL SYSTEM FOR WATER LINE ISOLATION AND METHOD

FIELD OF THE INVENTION

This invention relates to a valve control system of a water distribution network of a building.

BACKGROUND OF THE INVENTION

In buildings with multiple floors or a large floor area, the associated water distribution network may be quite extensive. It is necessary to use a valve system to control the flow of water in various portions of the water distribution network in order that the entire building's water supply will not be interrupted during repair work or system modification. Conventionally, screw-type valves have been used to shut off water flow in a particular portion of a water distribution network while allowing unrestricted water flow throughout the other areas of the system.

In order to assure a tight seal, screw-type valves are generally fine-threaded and require a considerable amount of time and physical effort to open and close. Screw-type valve constructions must be installed in readily accessible locations for operation and maintenance.

The foregoing systems have no provisions for regulating the flow of water throughout a building from a remote location. As a consequence, water supply control in buildings is dependent upon access and operation of screw-type valves.

The use of gas-operated pinch valves eliminates the time-consuming laborious task of closing screw-type valves. Also, pinch valves may be located inside a wall or at other inconspicuous locations, because access is not required to operate the pinch valve and the corrosion problems associated with metal screw-type valves do not affect the rubber and/or synthetic materials used in the pinch valves.

Many significant advantages are obtained by using a pinch valve instead of a screw-type valve. A pinch valve does not require regular maintenance, because a pinch valve can be constructed of chemically resistant materials. In the event of valve failure, a pinch valve will fail in the open position allowing unrestricted water flow through the water pipe. Furthermore, the pinch valve will not leak when broken because it is contained inside the conduit. A pinch valve will form around an obstruction inside a pipe and seal off the water flow around the obstruction, unlike a conventional screw-type valve which will continue to leak when it meets an obstruction.

Pinch valves are simple to operate. The fluid pressure in the valve need only be a few pounds higher than the water pressure in the pipe to effectively seal the valve. Typically, water in the system is pressurized at about 60 psi. Pressures greater than 60 psi can be obtained in the pinch valve using, for example, a hand pump attached to a valve stem on the pinch valve assembly or by using a portable air canister.

In view of the above, it can be seen that there is a need for a system which allows selected opening and closing of individual valves throughout a building for allowing water flow to be selectively regulated. The disclosed invention provides just such a system and method, and one which not only achieves the selective valve actuation, but also includes remote valve control.

SUMMARY OF THE INVENTION

A system for regulating water flow in a water distribution network in a building includes a water supply means for supplying water to the water distribution network in the building and pinch valve means located in the water distribution network for regulating water flow in at least a portion of the network. The system also includes a source of compressed fluid in communication with the pinch valve means for activating the pinch valve means to restrict water flow in a portion of the water distribution network. The system also includes fluid control means connected to the compressed fluid source for regulating the compressed fluid flow to and from the pinch valve means. The control means includes a locking position wherein the pinch valve means is lockable in either a pressurized or depressurized position.

The pinch valve control system for water line isolation also includes a hot and cold water regulating system for a building comprising a main hot water line and a main cold water line positioned within a building and a series of stations being connected to each of the main hot and cold water lines. Each of these stations includes a hot water branch line and a cold water branch line. Each of the hot water branch lines and cold water branch lines includes a water dispensing valve. Each of the branch lines further includes flow interruption means for selectively shutting off water flow in each of the branch lines. The flow interruption means includes pinch valve means. A control station includes means connected to the flow interruption means for automatically selectively operating any one of the flow interruption means to disconnect the branch line which has the flow interruption means from the main line.

The invention also includes a method for regulating water flow in a water distribution system having a network of water conduit means and remote controlled water flow interruption means connected to the conduit means, the method comprising the steps of providing a remote controlled water flow interruption means which is electrically operated from a remote switch location and actuating at the remote switch location an electrically operable switch to activate the remote controlled water flow interruption means thereby interrupting the flow of water at the water flow interruption means and restoring the flow of water in the system by actuating at the remote switch location an electrically operable switch to deactivate the remote controlled water flow interruption means.

These and other features and advantages of the invention will be readily apparent in view of the following description and drawings of the above-described invention.

BRIEF DESCRIPTION OF THE DRAWINGS

The above and other objects and advantages and novel features of the present invention will become apparent from the following detailed description of the preferred embodiment of the invention illustrated in the accompanying drawings, wherein.

DETAILED DESCRIPTION OF THE INVENTION

Figure 1:
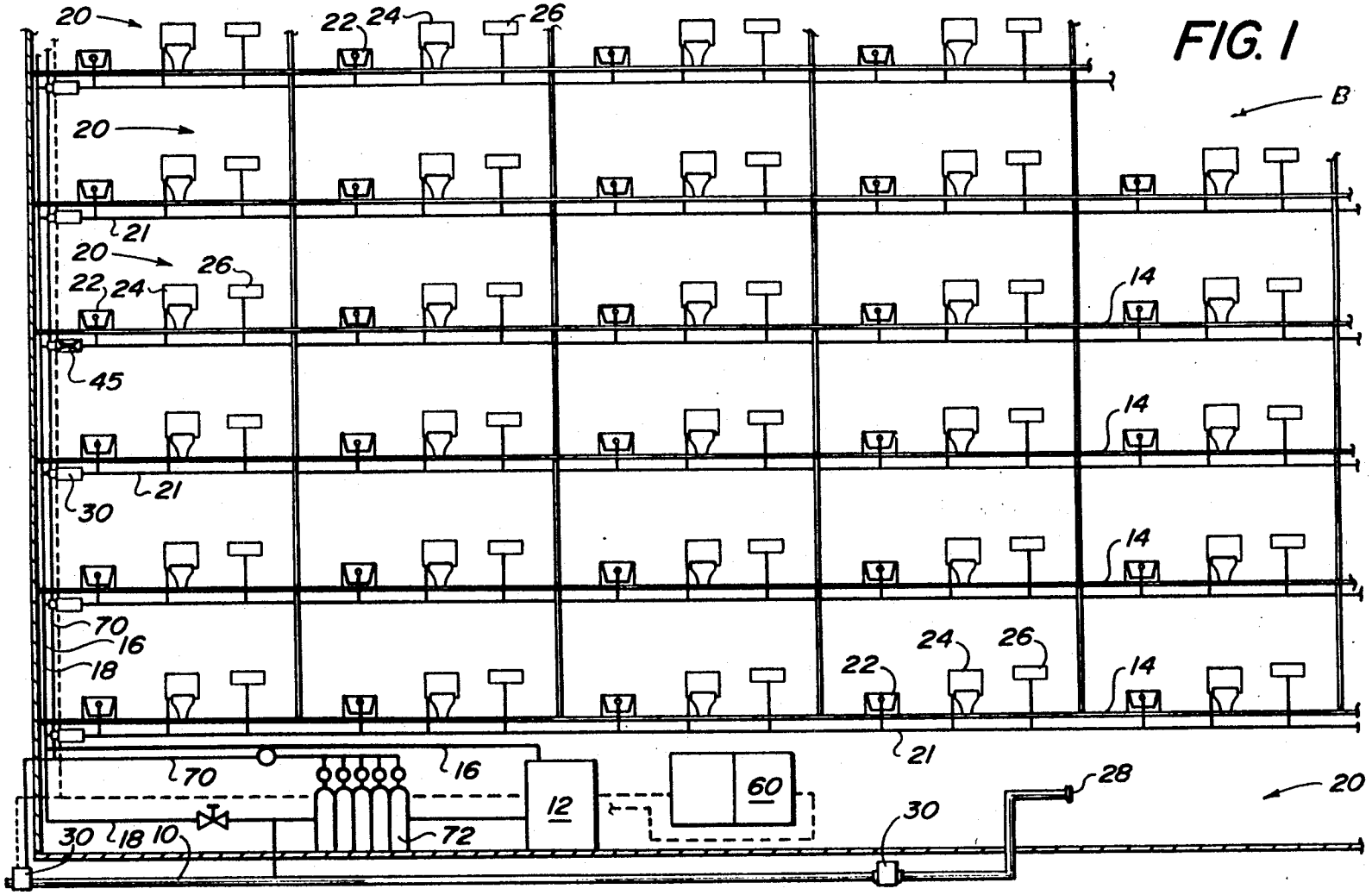
FIG. 1 is a diagrammatic representation of a multi-floor building in which the system of this invention is installed.

A multi-floored building B is shown in FIG. 1 having the pinch valve control system installed therein. Water is supplied to the system via a water supply main 10. A portion of the cold water from the water main 10 is diverted to a boiler 12 which heats the water to provide hot water to the floors 14 through a building hot water conduit 16. Cold water is supplied to the floors 14 above through a building cold water conduit 18. Conduits 16 and 18 supply water through the water distribution network of the building B to all water-using stations 20 in building B by branch lines 21 extending from conduits 16 and 18. A station 20 may be either a full bathroom having a bathtub 22, a toilet 24, and a washbasin 26, each having independently operated valves, or the station 20 may be a single fixture having only one valve such as a fire hydrant 28.

Figure 2:
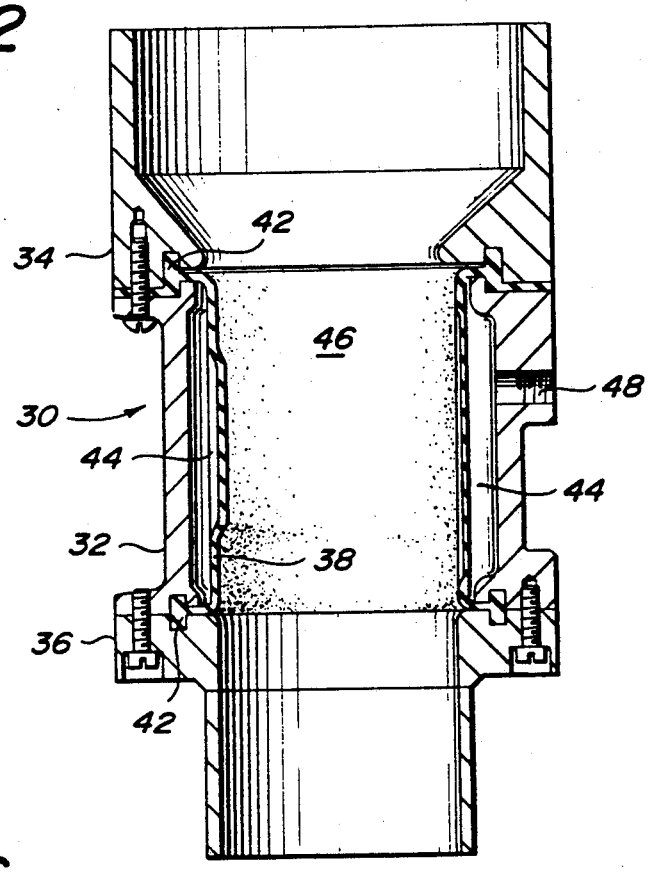
FIG. 2 is a cross sectional view of a pinch valve.
Figure 3:
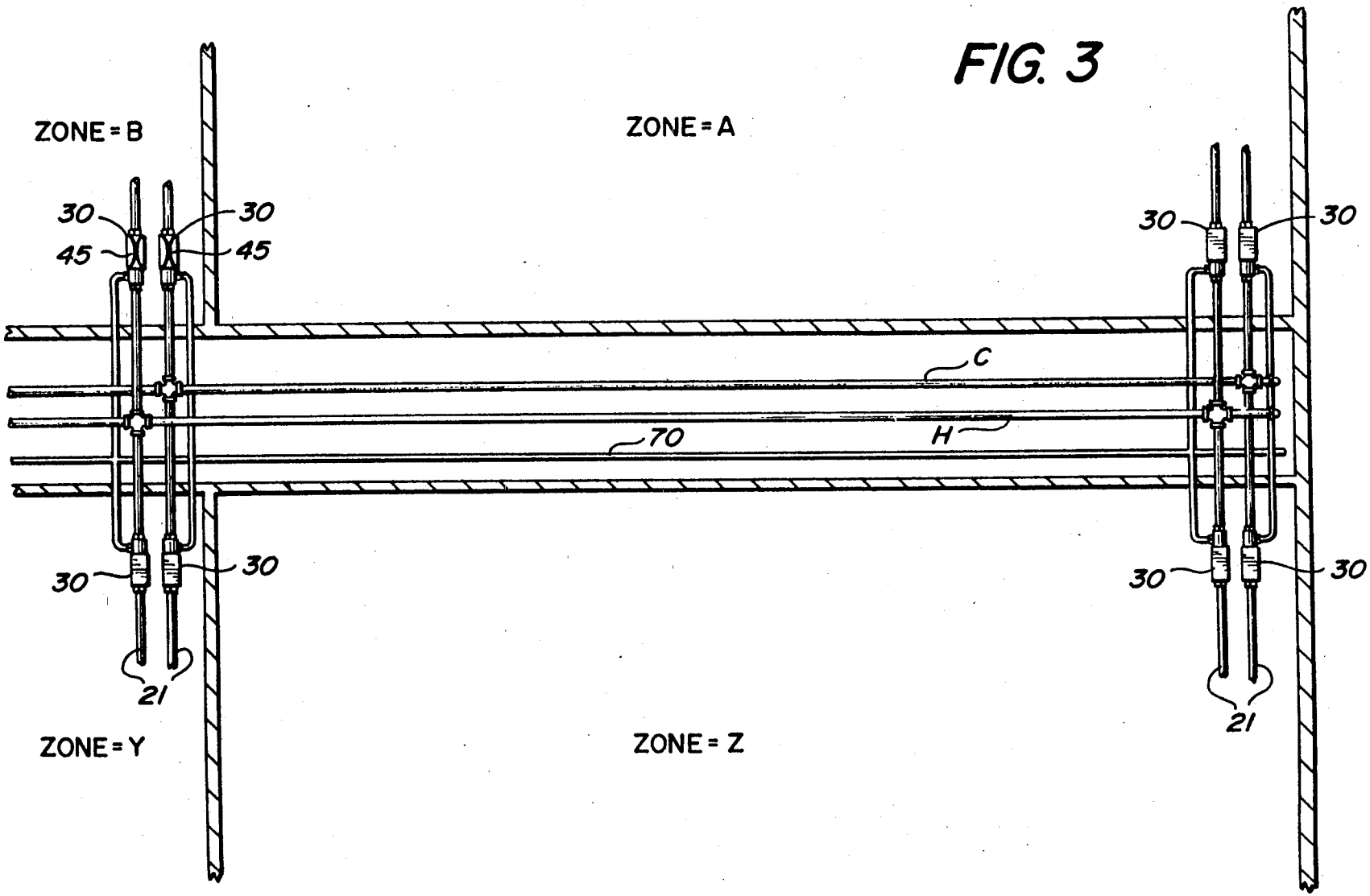
FIG. 3 is a schematic plan view illustrating hot and cold water supply lines having pinch valves connected thereto to form distribution zones.

As best shown in FIGS. 2 and 3, pinch valves 30 are used to regulate water flow in the water distribution system. As best shown in FIG. 2, each pinch valve 30 is formed by a conduit section 32 connected between two conduit sections 34 and 36. Pinch valve 30 has an annular resilient sleeve 38 located inside conduit section 32. Resilient sleeve 38 is securely attached at each end 40 and 42 to provide a watertight seal surrounding a chamber 44. When pinch valve 30 is activated, as shown by closed pinch valves 45 in FIGS. 1 and 3, chamber 44 is pressurized, as sleeve 38 is collapsed, closing aperture 46, and stopping the flow of water through tubular aperture 46. The chamber 44 has a fluid entry tube 48 extending therein for outflow and inflow of the pressurizing fluid through conduit section 32. An exemplary pinch valve is disclosed in U.S. Pat. No. 4,111,391, the disclosure of which is incorporated herein by reference.

A typical arrangement of the above-described pinch valve system is shown in FIGS. 1 and 3. Such a design allows water to be interrupted at an individual floor 14 without disturbing water flow to any other floors 14. Additional pinch valves 30 may be installed at various locations throughout each floor 14 thereby creating separate control areas shown in FIG. 3 as zones A, B, . . . , Y and Z to further control water distribution and further localize interrupted water service. Pinch valves 30 may also be installed in branch lines 21 which provide water to each station 20.

Figure 4:
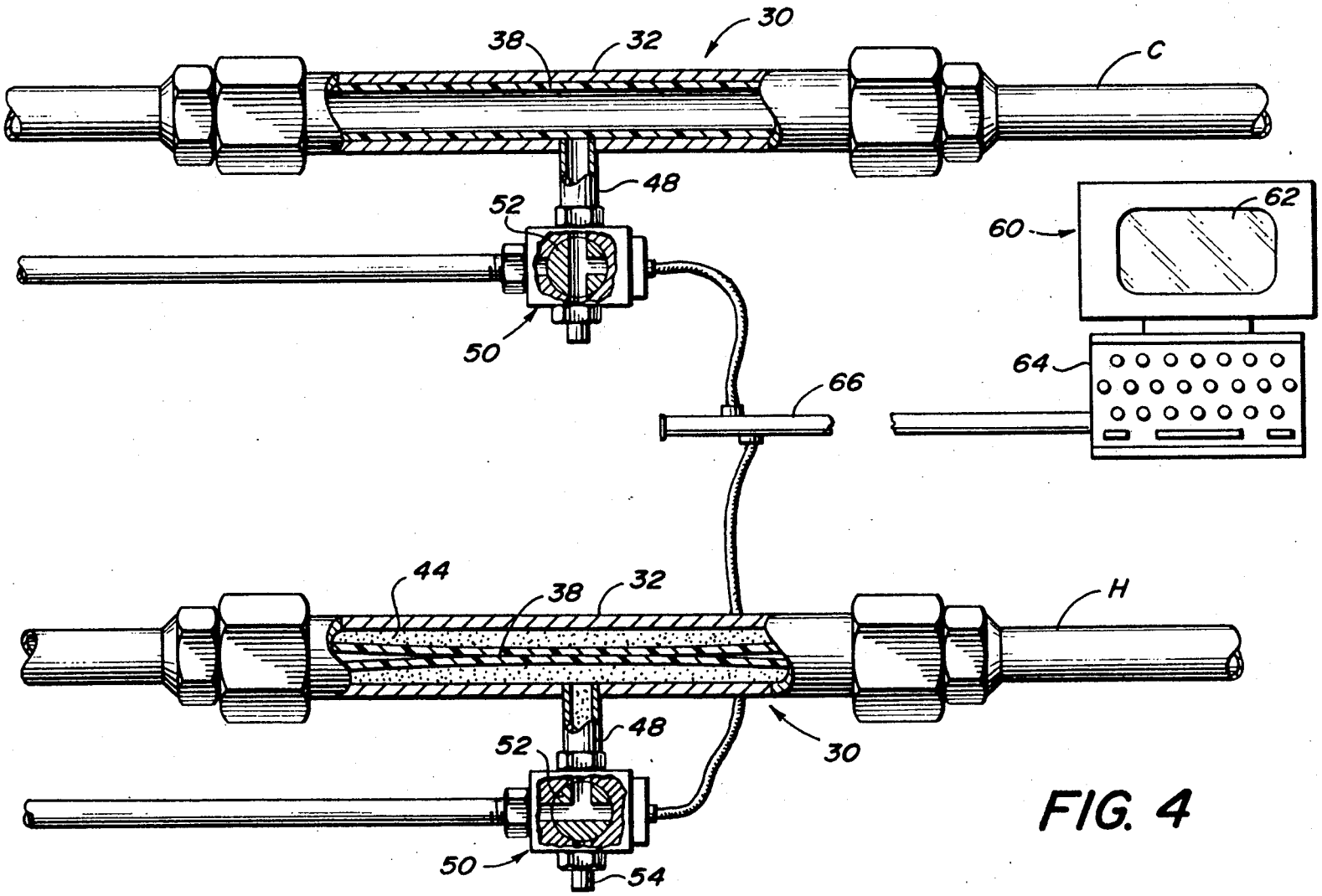
FIG. 4 is a plan view of the solenoid controlled pinch valve of FIG. 1 with portions shown in cross section and connected to hot and cold water lines.

As best shown in FIG. 4, each pinch valve 30 is operated by a solenoid controlled valve 50 which allows a pressurized fluid, such as nitrogen, to flow into the chamber 44. Nitrogen gas is most commonly used in this type of system due to its non-flammable nature.

Figure 5:
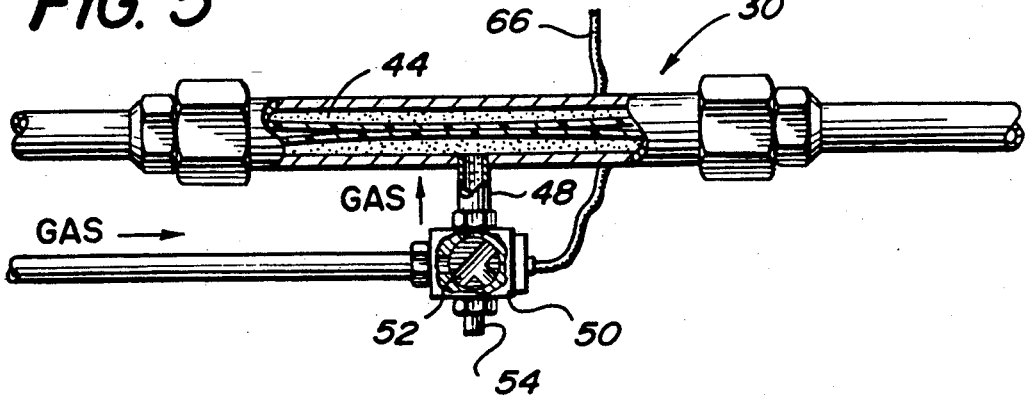
FIG. 5 is a cross-sectional view of a solenoid controlled pinch valve of FIG. 4 in the locked position.

Solenoid valve 50 includes a valve mechanism 52 which is selectively positionable in either one of a first depressurized position where fluid in the chamber 44 is allowed to exhaust through passageway 54 as exemplified by pinch valve 30 attached to the cold water line C of FIG. 4, and a second position wherein fluid is permitted to flow through fluid entry tube 48 for pressurizing pinch valve 30 as shown in the pinch valve 30 of the hot water line H of FIG. 4. A third position, shown in FIG. 5 is also available where the solenoid valve mechanism 52 locks the pinch valve 30 in either a pressurized or depressurized condition. The locking position of the solenoid controlled valve is very important to prevent opening of a pressurized pinch valve 30 in the event of an electrical power outage or loss of pressurized fluid supply.

Figure 6:
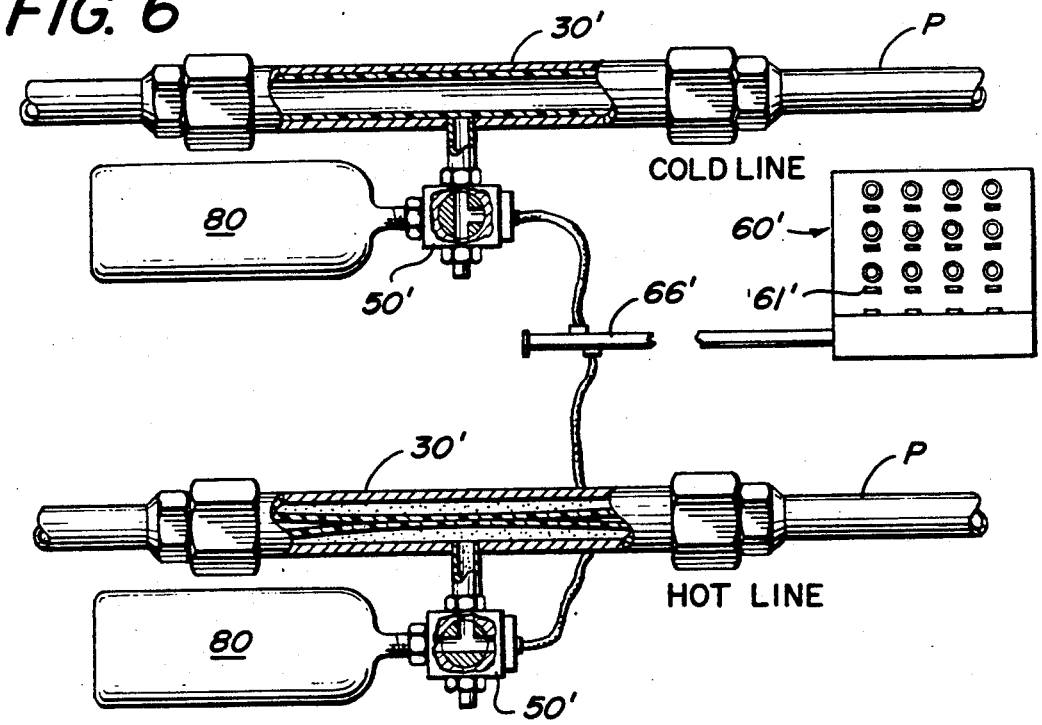
FIG. 6 is an plan view of a pair of solenoid controlled pinch valves being directly connected to compressed air canisters and hot and cold water lines with portions shown in cross-section.

Each solenoid valve mechanism 52 is operated by an electrical signal sent from remotely located central control station 60 which is electrically connected to the building power supply. Control station 60 can be as simple as a set of switches 61 controlling each mechanism 52 as shown in FIG. 6, but is preferably a computerized monitor system, as shown in FIG. 4, having a video display screen 62 and keyboard 64 for selectively controlling the operation of individual pinch valves 30 as well as distribution zones.

Control station 60 may also include its own stored energy supply, such as batteries, in order that the water system may be interrupted or resumed even if the building power supply is unavailable.

Electrical line 66 provides an independent signal from control station 60 to each solenoid valve mechanism 52 so that each solenoid controlled valve 50 may be operated independently and designated areas for water flow interruption throughout the building distribution network can be selectively operated.

As best shown in FIG. 1, pressurizing fluid is provided through fluid supply line 70 from compressed air tanks 72 to each pinch valve 30. Fluid flow between supply line 70 and pinch valve 30 is controlled by the associated solenoid controlled valves 50.

Figure 7:
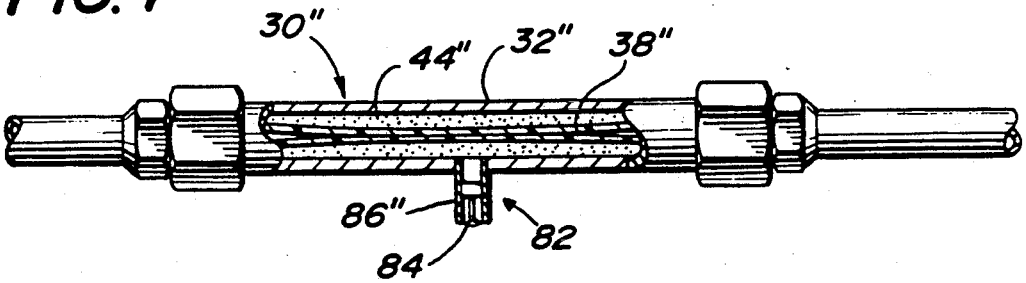
FIG. 7 is a plan view of a pinch valve of an alternative embodiment with portions broken away to reveal a needle valve.
Figure 8:
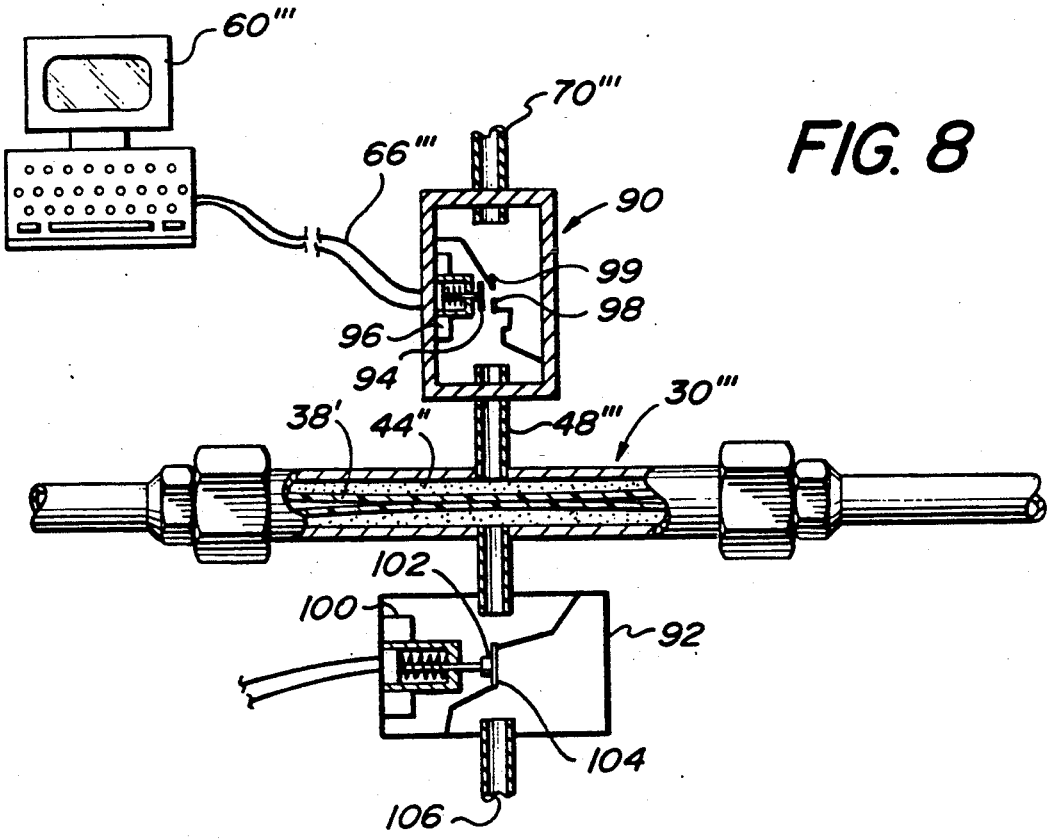
FIG. 8 is a plan view of a pinch valve control assembly of an alternative embodiment with portions broken away showing solenoid controlled valve structure.

In the embodiment of FIGS. 6 through 8 like parts of those of the preferred embodiment are identified by like prime numbers. In the embodiment of FIG. 6, small gas canisters 80 are attached directly to each solenoid controlled valve 50'. This eliminates the need for installing a fluid supply line, such as the line 70 of FIG. 1, throughout a building. By elimination of the supply line 70, an existing building may be retrofitted to replace each conventional screw-type valve with a pinch valve 30'.

Retrofitting of an existing screw-type water distribution system includes removal of the screw-type valve (not shown) on the water pipe P of FIG. 6. As the fittings may be corroded to the pipe P, cutting of the pipe P may be necessary before a pinch valve 30' can be installed. Installation of pinch valve 30' may require rethreading of the existing water pipe and then threading the pinch valve 30' onto the existing water pipe P. After installation of the pinch valve 30', solenoid controlled valve 50' is installed and connected to electrical line 66 which extends from the central control station 60'. After operation of solenoid controlled valve 50' is checked, gas canister 80 is installed on solenoid controlled valve 50' and the pinch valve 30' is operational. The valve 50' may be manually operable.

In the embodiment of FIG. 7, a pinch valve 30'' is shown having a manually operable fluid pressure valve 82 for facilitating introduction of a pressurizing fluid, such as air. The air may be applied to the valve by a conventional hand pump (not shown) or a conventional portable air canister (also not shown). Pressure valve 82 is a needle valve having a movable needle 84, which, when depressed, allows the transfer of pressurized fluid through the pressure valve 82 to either pressurize or depressurize the chamber 44'' of pinch valve 30''.

In FIG. 8, another embodiment of a solenoid controlled pinch valve 30''' is shown wherein a pair of solenoid controlled valves 90 and 92 are used to control fluid inflow and exhaust from valve 30'''.

Fluid inflow into pinch valve 30''' is controlled by movement of a plunger 94. When a switch 61''' of control station 60''' is activated, a signal is sent through electrical line 66''' and a coil 96 is energized and plunger 94 is drawn away from the seat 98 by the resultant magnetic force. The movement of plunger 94 causes an opening in the seat 98 and fluid flows through valve 90, through entry tube 48''' and into chamber 44''' to collapse resilient sleeve 38'''.

Deactivation of the coil 96 locks the pinch valve 30''' in the pressurized condition and water flow through the aperture 46''' is restricted.

To release the pressure in the chamber 44''' another remote switch 61''' is activated in the manner described in the pressurization procedure. This causes activation of the coil 100 to draw plunger 102 away from seat 104 and fluid is allowed to exhaust through solenoid controlled valve 92.

It should also be noted that it is not necessary that the solenoid controlled valves 50, 90, or 92 or a manually operated valve 82 be located directly at the pinch valve 30. It is contemplated that either of the valves could be located spaced from the pinch valve 30, but connected thereto by a fluid supply line 70 or a combination supply and exhaust line 86.

Operation and actuation of the pinch valve control system for regulating the flow of water throughout the water distribution network of building B is described below.

OPERATION OF THE SYSTEM

After the pinch valve water distribution control system is installed in a building B, the system is operated when a particular repair or modification of an existing water distribution network is required. After determining the area for which water service interruption is needed, the particular pinch valve or valves 30 are identified and each corresponding solenoid controlled valve 50 is activated by control station 60 to release compressed fluid into the pinch valve 30. As the relatively high pressure fluid flows into the chamber 44 surrounding the resilient sleeve 38, is flexible elastomeric sleeve 38 is pressurized, thereby closing the aperture 46 of the pinch valve 30 and stopping the flow of water. Repairs or modifications can then be made.

The procedure for resumption of water flow is similar. Control station 60 is used to transmit an electrical signal to the solenoid controlled valve 50. This causes valve mechanism 52 to change position so that the relatively high pressure fluid in the valve 30 is exhausted through solenoid controlled valve 50. The flexible elastomeric pinch valve sleeve 38 then resumes its original shape and water flow resumes through the pipes.

It should be recognized that the pinch valves 30 of the water distribution system can also be operated manually or remotely so that the speed of opening of aperture 46 will be controlled to avoid air hammers resulting from the sudden inflow of water. An operator can manually release the pressure in each pinch valve by positioning the valve mechanism 52 in the exhaust position. To pressurize pinch valve 30, the operator positions the valve mechanism 52 in the pressurization position and applies compressed fluid to pinch valve 30. Of course, other varieties of inflation and deflation valves may be used if the system is to be operated manually as discussed in regard to FIG. 7, for example.

While this invention has been described as having a preferred embodiment, it is to be understood that the invention is capable of further modification, uses, and/or adaptations which follow in general the principle of the invention and includes such departures from the present disclosure as come within known or customary practice in the art to which the invention pertains, and as may be applied to the central features hereinbefore set forth, and fall within the scope of limits of the appended claims.

What is claimed is:

1. A system for regulating water flow in a water distribution network in a building, the system comprising:
   a) a water supply means for supplying water to the water distribution network in the building;
   b) pinch valve means located in the water distribution network for regulating water flow in at least a portion of the network;
   c) a source of compressed fluid in communication with said pinch valve means for activating said pinch valve means to restrict water flow in a portion of the water distribution network; and
   d) fluid control means connected to said compressed fluid source for regulating compressed fluid flow to and from said pinch valve means.

2. The system for regulating water flow of claim 1, wherein said fluid control means including a locking position wherein said pinch valve means is lockable in either a pressurized or a depressurized condition.

3. The system for regulating water flow of claim 1, wherein:
   a) said source of compressed fluid comprises compressed air tanks which are remotely located from said fluid control means.

4. The system for regulating water flow of claim 1, wherein:
   a) said source of compressed fluid comprises a compressed air canister directly connected to said fluid control means.

5. The system for regulating water flow of claim 1, wherein:
   a) said fluid control means is remotely operable.

6. The system for regulating water flow of claim 1, wherein:
   a) said fluid control means includes a manually operable needle valve.

7. The system for regulating water flow of claim 1, wherein:
   a) said fluid control means includes an electrically operable solenoid controlled valve.

8. The system for regulating water flow of claim 7, wherein:
   a) said fluid control means is operable remotely by a signal from a central control station.

9. The system for regulating water flow of claim 8, wherein:

a) said water supply means includes pinch valve means for regulating water flow to the entire water distribution system.

10. The system for regulating water flow of claim 8, wherein:

a) the water distribution network includes a plurality of water distribution zones; and b) said pinch valve means are located in the water distribution network so that water flow may be interrupted selectively in each of said zones.

11. The system for regulating water flow of claim 10, wherein:

a) at least one of said water distribution zones includes a plurality of stations therein; and b) said pinch valve means is located in said zone to control water flow to a station.

12. A hot and cold water regulating system for a building, wherein:

a) said building includes a main hot water line and a main cold water line;

b) a series of stations, each station is connected to said main hot and cold water lines;

c) each station having a hot water branch line and a cold water branch line;

d) each hot and cold water branch line including a water dispensing valve;

e) each hot and cold water branch line including flow interruption means for selectively shutting off water flow in each branch line;

f) said flow interruption means including pinch valve means; and, g) a control station including means connected to each of the flow interruption means for automatically selectively operating any one of said flow interruption means to regulate water flow in each branch line having flow interruption means installed therein.

13. The hot and cold water regulating system of claim 12, wherein:

a) said means connected to each of said flow interruption means including solenoid controlled valve means for selectively operating any one of said flow interruption means.

14. The hot and cold water regulating system of claim 13, further comprising:

a) means for monitoring the system at said control station.

15. The hot and cold water regulating system of claim 14, wherein:

a) said means for monitoring the system at said control station is a video display screen.

16. The hot and cold water regulating system of claim 12, wherein:

a) said pinch valve means includes manual shut-off means.

17. The hot and cold water regulating system of claim 16, wherein:

a) said manual shut-off means includes a valve for manual insertion of a pressurizing fluid into said pinch valve means; and, b) said valve further being operable to release a pressurizing fluid from said pinch valve means.

18. The hot and cold water regulating system of claim 17, wherein:

a) said manual shut-off means including coupling means for attaching of a compressed gas canister; and, b) said manual means for supplying gas to said shut-off means operates said selective flow interruption means upon insertion of the gas therein.

19. A system for regulating water flow in a water distribution network, the system comprising:

a) a water supply network;

b) said water supply network further including branch means for supplying water to selected zones;

c) said water supply network having pinch valve means for selectively regulating water flow at predetermined zones within the network;

d) said pinch valve means being operable to interrupt water flow at the selected zones;

e) the water supply network having pinch valve means at each of the branch means for regulating water flow in each of the branch means; and, f) control means for remote electrical operation of said pinch valve means.

20. The system of claim 19, wherein:

a) said control means includes electrically operable solenoid controlled valves which regulate the flow of a fluid into and out of said pinch valve means.

21. The system of claim 20, wherein:

a) said control means further includes a control station electrically connected to and selectively operating each of said solenoid controlled valves.

22. The system of claim 21, wherein:

a) each of said solenoid controlled valves includes a fluid inflow position and a fluid exhaust position and a locked position.

23. The system of claim 19, wherein:

a) said pinch valve means includes manual shut-off means.

24. The system of claim 23, wherein:

a) said manual shut-off means includes a valve for manual insertion of a pressurizing fluid into said pinch valve means; and, b) said valve further being operable to release a pressurizing fluid from said pinch valve means.

* * * * *